United States Patent [19]

Knell et al.

[11] Patent Number: 4,616,433

[45] Date of Patent: Oct. 14, 1986

[54] RIPPING BUCKET ARRANGEMENT

[75] Inventors: Harvey A. Knell; Lloyd B. Rumble, both of Yorkville, Ill.

[73] Assignee: Caterpillar Inc., Peoria, Ill.

[21] Appl. No.: 700,239

[22] Filed: Feb. 12, 1985

[51] Int. Cl.[4] ..... E02F 3/28

[52] U.S. Cl. ..... 37/141 T; 37/DIG. 12; 172/777

[58] Field of Search ..... 37/103, DIG. 12, 141 R, 37/141 T, 142 R, 142 A, 118; 172/777; 414/722

[56] References Cited

U.S. PATENT DOCUMENTS

| | | | |
|---|---|---|---|
| 1,783,831 | 12/1930 | Downie | 414/726 |
| 2,660,323 | 11/1953 | Carlesimo | 37/141 T |
| 2,979,838 | 4/1961 | Raymond et al. | 37/141 R X |
| 3,061,123 | 10/1962 | Rogers | 37/141 R |
| 3,334,431 | 8/1967 | Phillips | 37/142 A |
| 3,748,762 | 7/1973 | Tarrant | 37/142 A X |
| 3,897,641 | 8/1975 | Moser | 37/141 R |
| 4,037,337 | 7/1977 | Hemphill | 37/141 R |
| 4,041,624 | 8/1977 | Fryrear | 37/117.5 |
| 4,271,614 | 6/1981 | Albrecht | 37/103 |
| 4,279,085 | 7/1981 | Arnold | 37/103 |

FOREIGN PATENT DOCUMENTS

| | | | |
|---|---|---|---|
| 1365139 | 5/1964 | France . | |
| 1210129 | 10/1970 | United Kingdom . | |
| 306228 | 6/1971 | U.S.S.R. | 37/141 R |

OTHER PUBLICATIONS

"Esco Have The Edge" p. 11 Construction Plant & Equipment, Apr. 1977.

*Primary Examiner*—Edgar S. Burr
*Assistant Examiner*—Moshe I. Cohen
*Attorney, Agent, or Firm*—William C. Perry

[57] ABSTRACT

Among the variety of bucket arrangements that are commonly available, several are specifically designed for ripping applications in materials that are extremely hard to penetrate. While these types of buckets are normally satisfactory in ripping hard, strong, brittle materials, their designs do not lend themselves to excavating and dumping weaker more plastic materials and thus exhibit little or no versatility. The bucket arrangement of the subject invention includes a first and second ground penetrating means that are selectively positioned on the bucket with respect to each other. The selective positioning allows sole engagement of either of the first or second ground penetrating means with the ground or simultaneous engagement of both penetrating means with the ground. Such an arrangement provides superior operation in a ripping capacity and yet the selective positioning of the first and second penetrating means also permits excellent operation in weaker or plastic materials.

8 Claims, 8 Drawing Figures

RIPPING BUCKET ARRANGEMENT

DESCRIPTION

1. Technical Field

This invention relates to bucket arrangements and more particularly to an excavator bucket arrangement that is utilized in both ripping and conventional trenching applications.

2. Background Art

In the operation of an excavator, it is not uncommon for an operator to encounter several different types of soils as well as several different types of excavation. In order to operate with optimum efficiency, different types of buckets are normally utilized to accommodate the specific type of material or operation being performed at a particular location. There are, however, certain areas that are comprised of materials that are extremely difficult to fracture or penetrate with a conventional excavator bucket. As a result, several bucket modifications have been designed specifically for ripping applications in extremely hard types of soils. These types of buckets, however, demonstrate very little versatility when an attempt is made to excavate in a material that requires a function other than ripping.

Also, in some instances where versatility of a bucket design is sought, the aggressive configuration of the cutting edge that is required in ripping applications will hinder its performance in weaker, plastic or sticky materials. Buckets encountering this problem often have a "V" or wedge shaped cutting edge that positions the teeth in the center of the bucket at a lower elevational plane than those positioned closer to the sides of the bucket. The wedge shape created by this design traps looser material between the teeth and induces packing. This occurrence reduces the capacity of the bucket as well as its ability to load or release the material when dumping.

The present invention is directed to overcoming one or more of the problems as set forth above.

DISCLOSURE OF THE INVENTION

In one aspect of the present invention, a bucket arrangement is provided that defines a bottom portion and a pair of sidewalls and is movable in a forward, material receiving, direction. A cutting edge is defined on the bottom portion of the bucket and a first penetrating means is defined by each sidewall. The first penetrating means extends forwardly from the sidewalls and is positioned elevationally above the cutting edge. A second penetrating means is connected to the cutting edge and extends downwardly therefrom at a preselected angle with respect to the first penetrating means.

A bucket arrangement as set forth above, not only operates extremely well in ripping applications required in very hard materials, but also is extremely efficient when operating in weaker, more plastic materials.

BEST MODE FOR CARRYING OUT THE INVENTION

Figure 1:
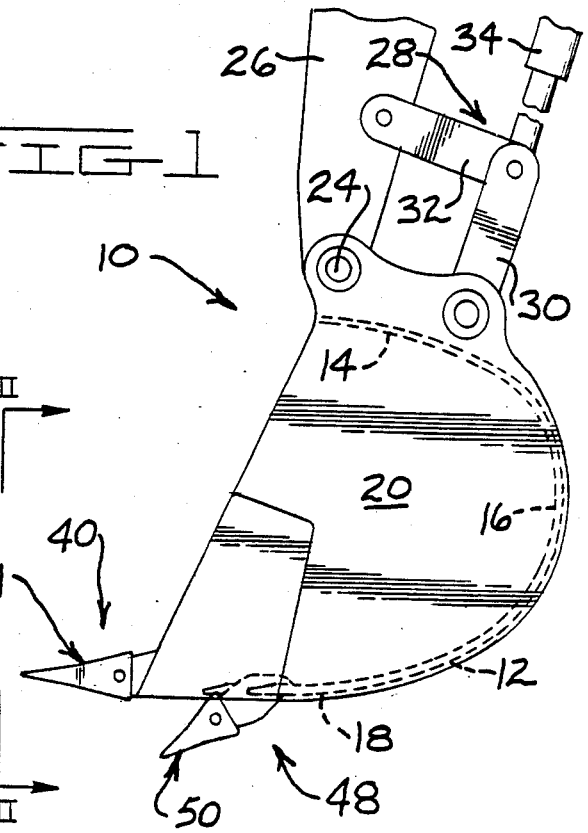
FIG. 1 is a side elevational view of an excavator bucket arrangement that embodies the principles of the present invention.
Figure 2:
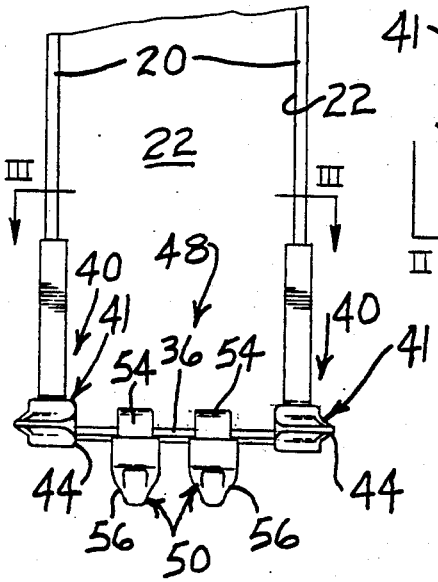
FIG. 2 is a front elevational view taken along lines II—II of FIG. 1.
Figure 3:
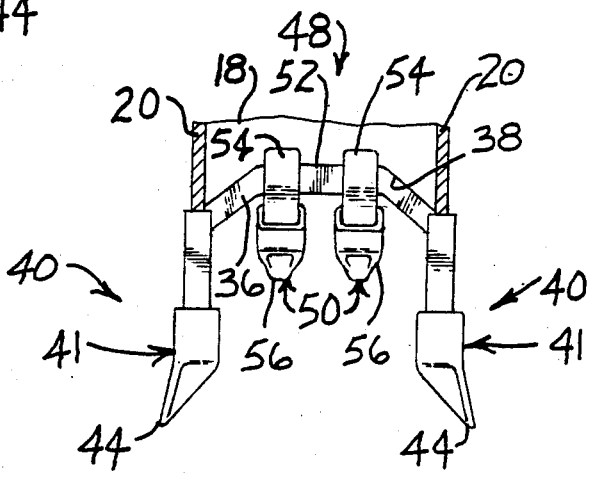
FIG. 3 is a partial sectional view taken along lines III—III of FIG. 2.
Figure 4:
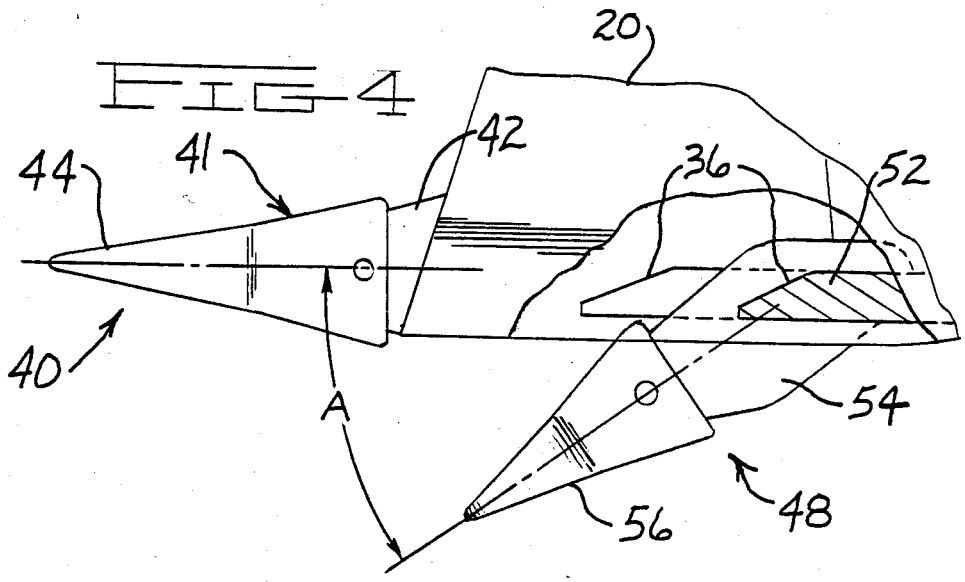
FIG. 4 is an enlarged fragmentary view of a portion of the bucket arrangement as indicated in FIG. 1.

Referring to FIG. 1 of the drawings, a bucket arrangement for a construction vehicle, such as an excavator or backhoe, is shown generally at 10. The bucket is generally defined by a shell configuration having a continuous wrapper plate 12 that forms an upper portion 14, a back portion 16 and a bottom portion 18. A pair of plates 20 are positioned on opposite sides of the wrapper plate 12 to form sidewalls of a material receiving receptacle 22.

The bucket 10 is pivotally mounted at 24 to a stick member 26 that is connected to the vehicle by a boom member (not shown). The bucket is rotated about its mounting 24 by a bucket control linkage 28 that includes a power link 30, an idler link 32, and a fluid actuated control cylinder 34. The cylinder 34 is positioned between the stick 26 and the bucket control linkage 28 and causes the bucket to rotate in a forward and rearward dirction as it is extended and retracted.

The bucket 10 is provided with a cutting edge 36 that is formed or otherwise positioned laterally along a forward portion 38 of the bottom portion 18 of the bucket. A first ground penetrating means 40, in the form of a ground engaging tooth assembly, 41 is formed on the bucket as an integral portion of each sidewall 20. Each tooth assembly 41 is of the type used in digging or ripping applications and includes a shank or adapter 42 that supports a removable tooth member 44. Each tooth assembly 41 extends from the sidewalls 20 at an angle that substantially coincides with that defined by the bottom portion 18 of the wrapper plate 12. Thus each tooth effectively forms an extension of the bottom portion 18 where it joins the sideplates 20. Such extension places the tooth members 44 at a position above the cutting edge 36. A second penetrating means 48 is connected directly to the cutting edge 36 and includes a second pair of ground engaging tooth assemblies 50. The second pair of teeth 50 are positioned along a central portion 52 of the cutting edge 36 and are generally equally spaced therealong with respect to the first pair of tooth assemblies 41 and each other. The construction of the second pair of tooth assemblies 50 are essentially the same as that of the first pair of tooth assemblies 41. Each of the second tooth assemblies 50 has a shank or adapter 54 that extends downwardly from the cutting edge 36 to support a removable tooth member 56. The shank 54 is positioned to extend below the cutting edge 36 at a preselected angle A of approximately 40 degrees with respect to the first pair of tooth assemblies 41. While an angle of 40 degrees is considered optimum, an angle within the range of 25 to 45 degrees is adequate.

Figure 5:
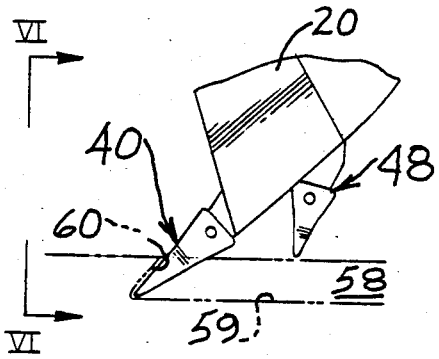
FIG. 5 is a reduced, diagrammatical side view of the present invention shown rotated to a first operating position.
Figure 6:
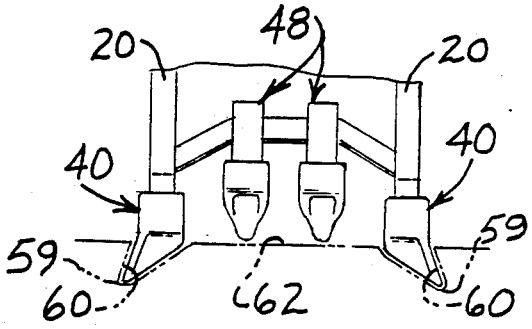
FIG. 6 is a front view taken along lines VI—VI of FIG. 5.
Figure 7:
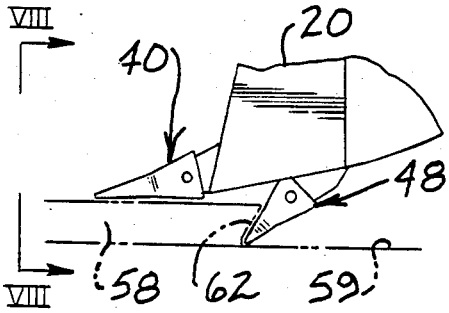
FIG. 7 is a reduced, diagrammatical side view of the present invention shown rotated to a second operating position.
Figure 8:
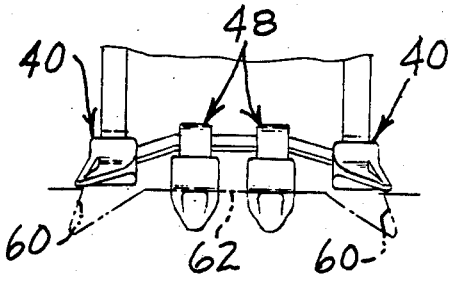
FIG. 8 is a front view taken along lines VIII—VIII of FIG. 7.

When operating the bucket assembly 10 in material that is extremely difficult to penetrate, such as homogenous limestone or coral, the control cylinder 34 of the bucket control linkage 28 is actuated to position the bucket 10 as shown in FIGS. 5 and 6. Through manipulation of the stick 26 and the boom members, in a well known manner, the bucket is moved in a forward direction to begin penetration of the ground and the subsequent removal of the fractured material from a trench 58 that is subsequently formed. With the bucket so positioned, only the first pair of ground engaging tooth assemblies 41 engage a bottom portion 59 of the trench 58 and fracture material that is located along an outer portion 60 thereof that is adjacent the sidewalls 20 of the bucket 10. Upon continuation of movement along the trench, the bucket 10 may be repositioned by the control cylinder 34 to an attitude shown in FIGS. 7 and 8. In this positon, the second pair of ground engaging tooth assemblies 50 may be brought into contact the trench 58 at a location behind the first pair of tooth assemblies 41. The second pair of teeth will engage the trench 58 to penetrate and fracture the material along a central portion 62 thereof. Since the material along the outer portion 60 of the trench has previously been fractured and/or removed, the material in the center will be much more easily penetrated and fractured. If desired, the bucket may be rotated to a position wherein only the second pair of tooth assemblies 50 will engage the trench. Finally, the bucket 10 may be positioned with both of the first and second pairs of ground engaging tooth assemblies 41 and 50 simultaneously engaged with the trench 58 and the entire floor portion thereof may be graded to relatively flat contour. The bucket 10 may also be utilized in this position when excavating in weaker materials to take a complete "bite", and fill the bucket receptacle at once. Since the cutting edge 36 has a substantially planar configuration and is part of a rectangular opening formed by the receptacle, the positioning of the first and second tooth assemblies 41 and 50 with respect to the cutting edge 36 will allow the bucket 10 to perform in a fashion similar to that of a general purpose bucket. When operating as such, the material packing that is inherent in many buckets designed primarily for ripping is avoided.

Other aspects, objects and advantages of this invention can be obtained from a study of the drawings, the disclosure, and the appended claims.

We claim:

1. A bucket arrangement defining a bottom portion and a pair of sidewalls, and being movable in a forward, material receiving direction comprising:

a planar cutting edge defined on the bottom portion of the bucket arrangement and extending between said sidewalls;

a first penetrating tooth assembly defined on a lower portion of each of said sidewalls at a location forward of the point at which the cutting edge joins the sidewalls and extending forwardly therefrom to a position that is elevationally above that of the cutting edge and being selectively positionable to be in sole ground engaging contact immediately adjacent the sidewalls of the bucket arrangement; and a plurality of second penetrating tooth assemblies connected to the cutting edge along a generally straight line with respect to each other and extending downwardly therefrom at a preselected angle with respect to the first penetrating tooth assembly and at a location spaced rearwardly therefrom, and being selectively positionable to be in sole ground engaging contact along an area between said first penetrating tooth assemblies.

2. The bucket arrangement as set forth in claim 1, wherein said bucket arrangement is utilized with an excavating vehicle and is adapted for use in digging trenches.

3. The bucket arrangement as set forth in claim 1 wherein the first penetrating tooth assembly is incorporated into the bucket arrangement as an integral portion solely of each of the sidewalls.

4. The bucket arrangement as set forth in claim 1 wherein the cutting edge is spaced rearwardly from the first penetrating tooth assembly to selectively permit the simultaneous ground engagement of both the first and second penetrating tooth assemblies to permit the leveling or grading thereof.

5. The bucket arrangement as set forth in claim 1 wherein the preselected angle includes a range of 20 to 45 degrees.

6. A bucket arrangement having opposed sidewalls and a bottom portion defining a planar cutting edge extending therebetween and being adapted for movement in a forward direction for excavation of material, comprising:

a first ground engaging tooth assembly defined by each of the sidewalls of the bucket arrangement at a location forward of the connection between said sidewalls and said cutting edge and extending therefrom to a position above said cutting edge; and a pair of second ground engaging tooth assemblies positioned in a generally straight line along the cutting edge of the bucket arrangement to extend downwardly therefrom at a preselected angle with respect to the first ground engaging teeth and being rearwardly spaced therefrom, said bucket arrangement being selectively operable between a first position wherein only the first ground engaging teeth are engaged with the ground at a location solely subjacent the sidewalls, and a second position wherein only the second ground engaging teeth are engaged with the ground subjacent the area solely between said sidewalls, and a third position wherein said first and second ground engaging teeth are in simultaneous engagement with the ground to permit the grading of the ground to a relatively flat profile.

7. The bucket arrangement as set forth in claim 6 wherein the preselected angle falls within a range of 20 to 45 degrees.

8. The bucket arrangement as set forth in claim 6 wherein said bucket arrangement is adapted for use with an excavator having a boom member and a stick member, said bucket arrangement being mounted on the stick member for relative rotation therewith between the first, second, and third positions by a bucket control linkage.

* * * * *